US005730112A

United States Patent [19]

Jeong

[11] Patent Number: 5,730,112

[45] Date of Patent: Mar. 24, 1998

[54] FUEL INJECTION QUANTITY FEEDBACK CONTROL SYSTEM OF A VEHICLE

[75] Inventor: Cheol-hwa Jeong, Pusan, Rep. of Korea

[73] Assignee: Hyundai Motor Co., Seoul, Rep. of Korea

[21] Appl. No.: 777,127

[22] Filed: Dec. 30, 1996

[30] Foreign Application Priority Data

Dec. 29, 1995 [KR] Rep. of Korea ..... 95-66765

[51] Int. Cl.[6] ..... F02D 41/14

[52] U.S. Cl. ..... 123/681; 123/696

[58] Field of Search ..... 123/681, 694, 123/696

[56] References Cited

U.S. PATENT DOCUMENTS

| | | | |
|---|---|---|---|
| 3,900,012 | 8/1975 | Wahl et al. | 123/696 X |
| 4,153,022 | 5/1979 | Asano et al. | 123/696 X |
| 4,461,258 | 7/1984 | Becker et al. | 123/696 X |
| 4,884,547 | 12/1989 | Tamura | 123/694 |
| 5,050,083 | 9/1991 | Uchida et al. | 123/696 X |

*Primary Examiner*—Tony M. Argenbright

*Attorney, Agent, or Firm*—Finnegan, Henderson, Farabow, Garrett & Dunner, L.L.P.

[57] ABSTRACT

A control system senses air quantity entering an engine, and oxygen in the engine exhaust. A controller controls an amount of fuel injected into the engine according to the sensed oxygen level. As the car changes speed, air flow to the engine changes. The controller converts sensed air flow into an efficiency parameter, and compares it to a setpoint. When an air flow changes and the setpoint is reached, the feedback control operation is suspended, and the controller changes the I-gain in a series of gradually changing steps. The gradual change in I-gain accordingly changes the amount of fuel injected in a series of gradually changing steps.

10 Claims, 5 Drawing Sheets

FUEL INJECTION QUANTITY FEEDBACK CONTROL SYSTEM OF A VEHICLE

BACKGROUND OF THE INVENTION

1. Field of the Invention

The present invention relates to a fuel injection quantity feedback control system of a vehicle. More particularly, the invention relates to a feedback control system in which a fuel injection quantity is changed to a predetermined quantity (declivity), thereby preventing a vehicle engine from receiving a shock caused by an abrupt change in the fuel injection quantity when the feedback control operation is suspended based on certain operating conditions of the vehicle.

2. Description of the Related Art

It is known to provide an oxygen sensor in a vehicle exhaust pipe to monitor oxygen content in the engine exhaust. The engine can then be controlled, during different operating conditions, by adjusting a fuel air mixture based on the sensed amount of oxygen in the exhaust.

The oxygen sensor is connected to a determination means, such as a microcomputer, to determine the quantity of oxygen in the exhaust. That is, the oxygen sensor senses the oxygen content in the exhaust gas, and outputs the sensed signal to the microcomputer. The microcomputer, in turn, determines the quantity of oxygen contained in the exhaust gas.

Next, it is determined whether the quantity of fuel currently being injected into the engine is rare or rich, with reference to a theoretical air fuel ratio, so that the fuel quantity can be increased or reduced based on the results of the determination.

The conventional system described above is arranged to perform a feedback compensation operation capable of adjusting the fuel injection quantity based on the quantity of oxygen contained in the exhaust gas. An optimum fuel quantity can be injected to the engine during changing operating conditions of the vehicle, thereby increasing the output efficiency of the engine.

In the conventional control system, however, the compensating operation for controlling the fuel injection quantity based on the oxygen content in the exhaust gas is suspended when an intake air quantity is reduced to a predetermined value due to speed reduction of the vehicle. When the feedback operation is suspended, fuel injection is performed only in accordance with a fixed predetermined value.

Therefore, there are occasions when a significant difference develops between the fuel quantity injected during operation of the feedback control system and the predetermined fuel quantity injected when the feedback control operation is suspended. This difference can become significant when control of the fuel injection quantity is suspended due to a change of the operating conditions of the vehicle, as well as when the compensating operation for controlling the fuel injection quantity recommences.

FIG. 6 depicts a prior art drop in I-gain, a factor controlled by the microcomputer in order to control the amount of fuel injected, in relation to engine RPM and volumetric efficiency, $E_v$(%). As can be seen, at a certain point, I-gain drops sharply, representing a shock to the engine.

The large difference between the controlled fuel injection quantity and the predetermined fuel injection quantity reduces the output efficiency of the engine.

Moreover, the engine receives a shock when the fuel quantity injected into the engine changes abruptly. This causes the engine to vibrate, thereby inconveniencing the driver.

SUMMARY OF THE INVENTION

An object of the present invention is to solve the above-mentioned problems and to provide a fuel injection quantity feedback control system of a vehicle in which an I-gain is changed gradually to a predetermined quantity, thereby preventing the vehicle engine from receiving a shock due to an abrupt change of fuel injection quantity when the feedback control operation for controlling the fuel injection quantity is suspended on the basis of the vehicle's operating conditions.

In accordance with the present invention, this object is accomplished by providing a fuel injection quantity feedback control system of a vehicle comprising: a first sensing unit sensing a quantity of air supplied to a vehicle engine combustion chamber, a second sensing unit for sensing an $O_2$ content in exhaust from the combustion chamber, a fuel injection unit for injecting fuel into the combustion chamber, and a controller receiving a first signal from the first sensing unit representing the sensed air quantity and converting the first signal into a parameter, and receiving a second signal from the second sensing unit representing the $O_2$ content, providing a control signal to the fuel injection unit to inject a selected quantity of fuel into the combustion chamber, and when the parameter reaches a setpoint, varying I-gain in a plurality of gradually changing steps.

In accordance with the invention, the fuel injection unit varies the amount of fuel injected in gradually changing steps as the I-gain varies in gradually changing steps.

BRIEF DESCRIPTION OF THE DRAWINGS

Other objects and aspects of the invention will become apparent from the following description of the preferred embodiment with reference to the accompanying drawings in which.

DETAILED DESCRIPTION OF THE PREFERRED EMBODIMENT

The preferred embodiment of the present invention will now be described in detail with reference to the accompanying drawings.

Figure 1:
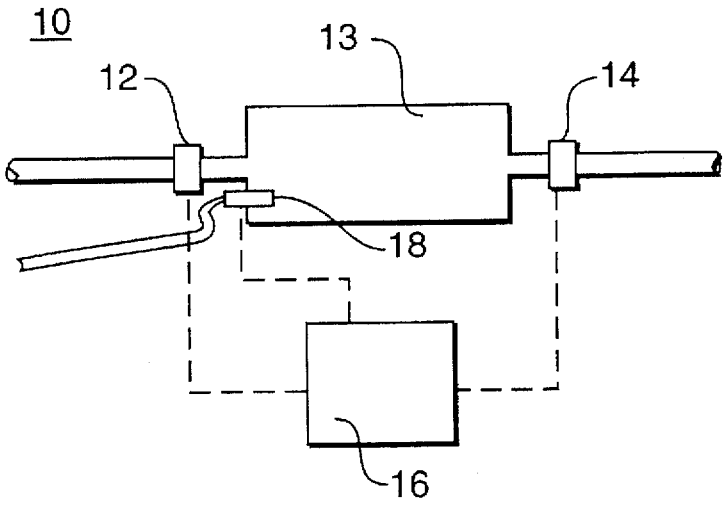
FIG. 1 is a schematic diagram illustrating a fuel injection quantity feedback control system of the present invention.
Figure 2:
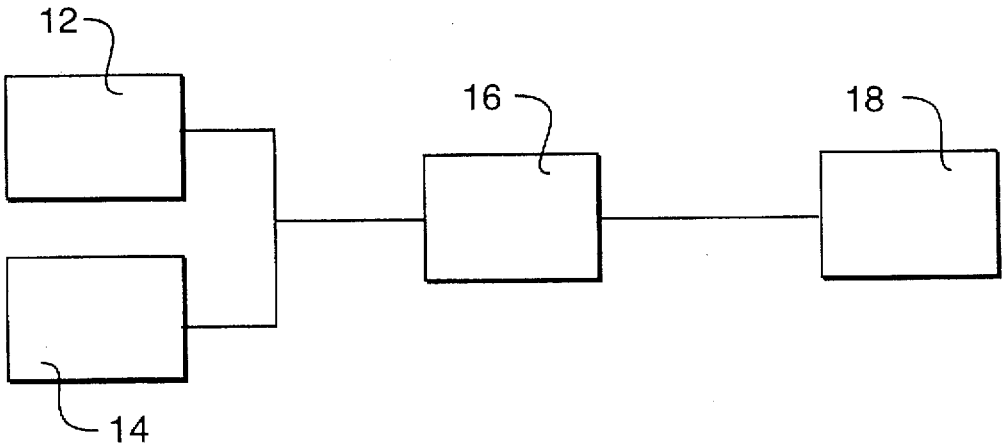
FIG. 2 is a block diagram of the system shown in FIG. 1.

FIGS. 1 and 2 illustrate a fuel injection quantity feedback control system of the present invention. As shown in FIG. 1, a fuel injection quantity feedback control system 10 is provided.

An intake air quantity sensing unit 12 senses a quantity of air sucked into a combustion chamber of an engine 13 and converts the sensed air quantity into an electrical signal. Likewise, an $O_2$ sensor 14 senses a quantity of $O_2$ in the vehicle exhaust pipe, as described above with respect to a conventional controller.

An engine control unit (ECU) 16 processes the sensed signal output from the intake air quantity sensing unit 12, and determines whether or not a feedback compensating operation for controlling the fuel injection quantity is being performed. ECU 16 also receives the $O_2$ signal from $O_2$ sensor 14 for adjusting the fuel air mixture. ECU 16 generates a control signal representing a desired fuel injection quantity, and can change the fuel quantity by changing the control signal, based on the sensed $O_2$ content in the exhaust.

A fuel injection unit 18 receives the control signal and injects the desired fuel quantity into the combustion chamber. The amount of fuel injection can vary by changing the control signal from the ECU 16.

Operation of the feedback control system disclosed in FIG. 1 will be explained with reference to the flowchart of FIG. 5. First, however, certain principles related to the operation of the feedback control system will be explained.

Engine volumetric efficiency, or Ev, is calculated according to the following equation:

$$Ev(\%) = \frac{A/N \times P_c}{V_c} \times 100 \quad (1)$$

In the above equation, A/N equals a number of air particles flowing into the system sensed by the air flow sensor 12, in terms of a number of pulses of a corresponding signal generated by the sensor per stroke (pulse/stroke).

$P_c$ is a pulse constant expressed in liter/stroke, and represents the relationship between each pulse of the corresponding signal and the amount of the actual air.

$V_c$ is a managing capacity, and refers to the amount of air flowing into the system as the piston is moved from a top position to a bottom position in the combustion chamber. $V_c$ is a fixed value in liter/stroke, with the value being different for each different vehicle model. For example, a 2000 cc engine has a $V_c$=500 cc/stroke, or 0.5 liter/stroke.

ECU 16 actually controls a value known as I-gain, which is explained below.

Given a fixed size nozzle for fuel injection unit 18, the amount of fuel provided to the engine combustion chamber is controlled by controlling the time period during which the nozzle of fuel injection unit 18 is open.

While the system is operating in a feedback (F/B) mode, i.e., during the period that the amount of oxygen flowing out of the exhaust pipe is being sensed and fuel injection controlled accordingly, the time duration that fuel is injected, $T_{inj}$ is:

$$T_{inj}=T_B \times K_{F/B} \times K_{misc}+Td \quad (2)$$

While the system is in an "open loop" mode, i.e., during the period that oxygen content in the exhaust is not sensed and the quantity of fuel injected is set at a predetermined setpoint, the time duration $T_{inj}$ is:

$$T_{inj}=T_B \times K_{A/F} \times K_{misc} \times T \quad (3)$$

In equations (2) and (3) above:

$T_B$=time required for the injector to operate to reach a theoretical air/fuel mixture value of 14.7;

$K_{misc}$=a fixed coefficient for compensating for changes in the atmosphere and/or temperature;

$T_d$=delay time;

$K_{A/F}$=a compensation coefficient defined experimentally based on the engine RPM and Ev(%);

$K_{F/B}$=a compensation coefficient, varying with the amount of $O_2$ sensed in the exhaust pipe by $O_2$ sensor 14.

Figure 3:
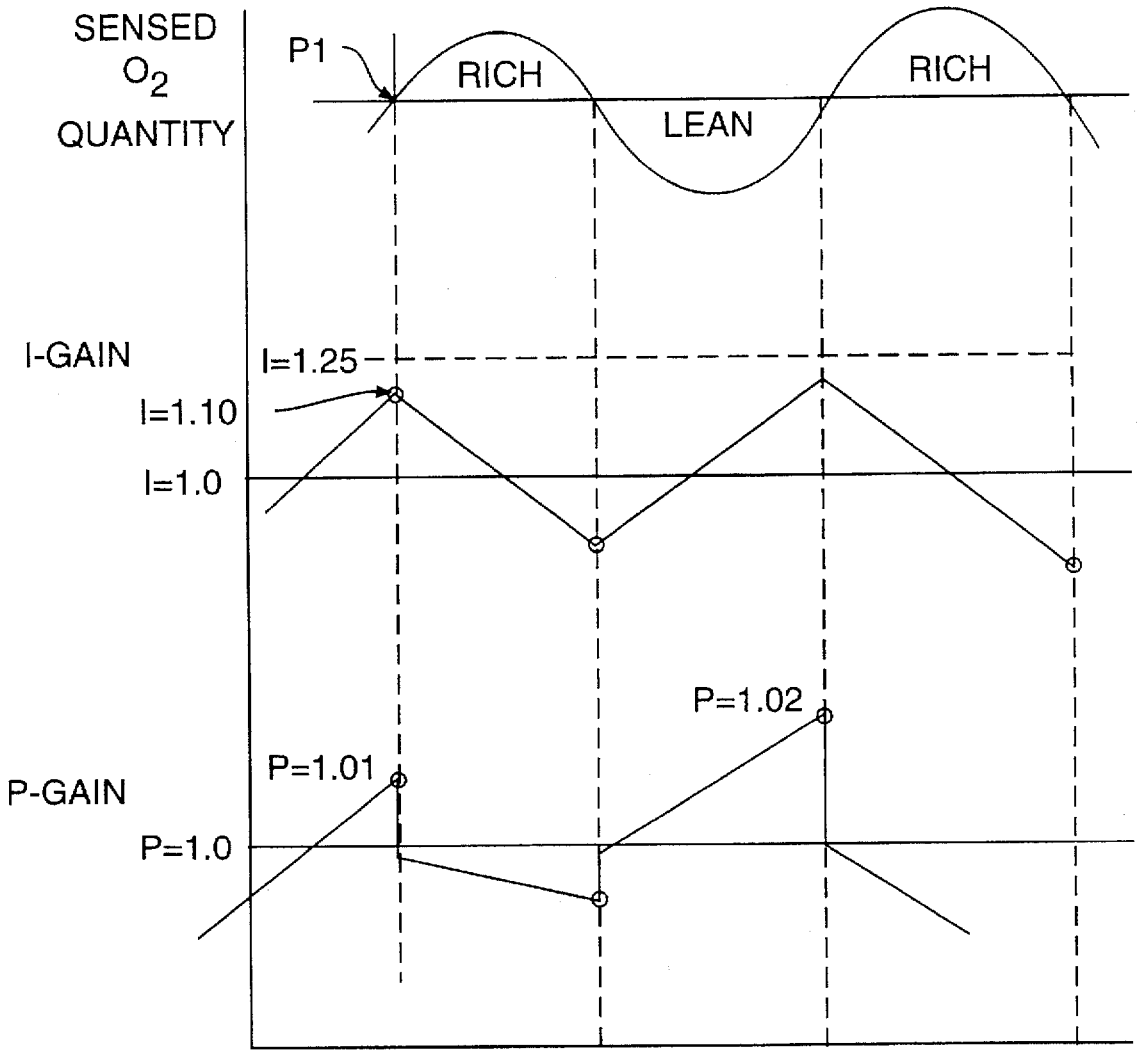
FIG. 3 is a graph illustrating a sensed amount of air at an exhaust pipe compared to I-gain and P-gain in accordance with the invention.

Moreover, $K_{F/B}$ is equal to the sum of the proportions gain, or P-gain, and the integration gain, or I-gain. The relationship between the amount of $O_2$ sensed by $O_2$ sensor 14, I-gain, and P-gain, is shown in FIG. 3. At point $P_1$ on FIG. 3:

I-gain=1.10 (i.e., 10% compensation)

P-gain=1.01 (i.e., 1% compensation) and $K_{F/B}$=11% compensation.

It will be understood from the above that I-gain influences $K_{F/B}$, which in turn influences $T_{inj}$, the time that the injector nozzle is open, which in turn controls the amount of fuel injected into the system. Since the amount of air flowing into the system is proportional to the extent that the throttle valve is open, control of $T_{inj}$ will correspondingly control the air fuel mixture. Furthermore, since $K_{F/B}$ is the only variable in the $T_{inj}$ equations (2) and (3) (all other components being fixed), varying I-gain will vary $K_{F/B}$, which in turn will vary $T_{inj}$, thereby varying the air fuel mixture in the engine.

The ECU 16 of the present invention therefore controls I-gain. At times when the engine slows down due to the driver removing pressure from the gas pedal, air flow into the engine sensed at air flow sensor 12 decreases. When the sensed amount of air flow decreases to a setpoint, the feedback control system stops, and the amount of fuel injected changes to a predetermined fixed amount. However, shock to the engine is avoided because ECU 16, rather than allowing the amount of fuel injected to drop suddenly to a setpoint, reduces the amount of fuel injected gradually by gradually reducing I-gain in a plurality of gradually changing steps.

Figure 4:
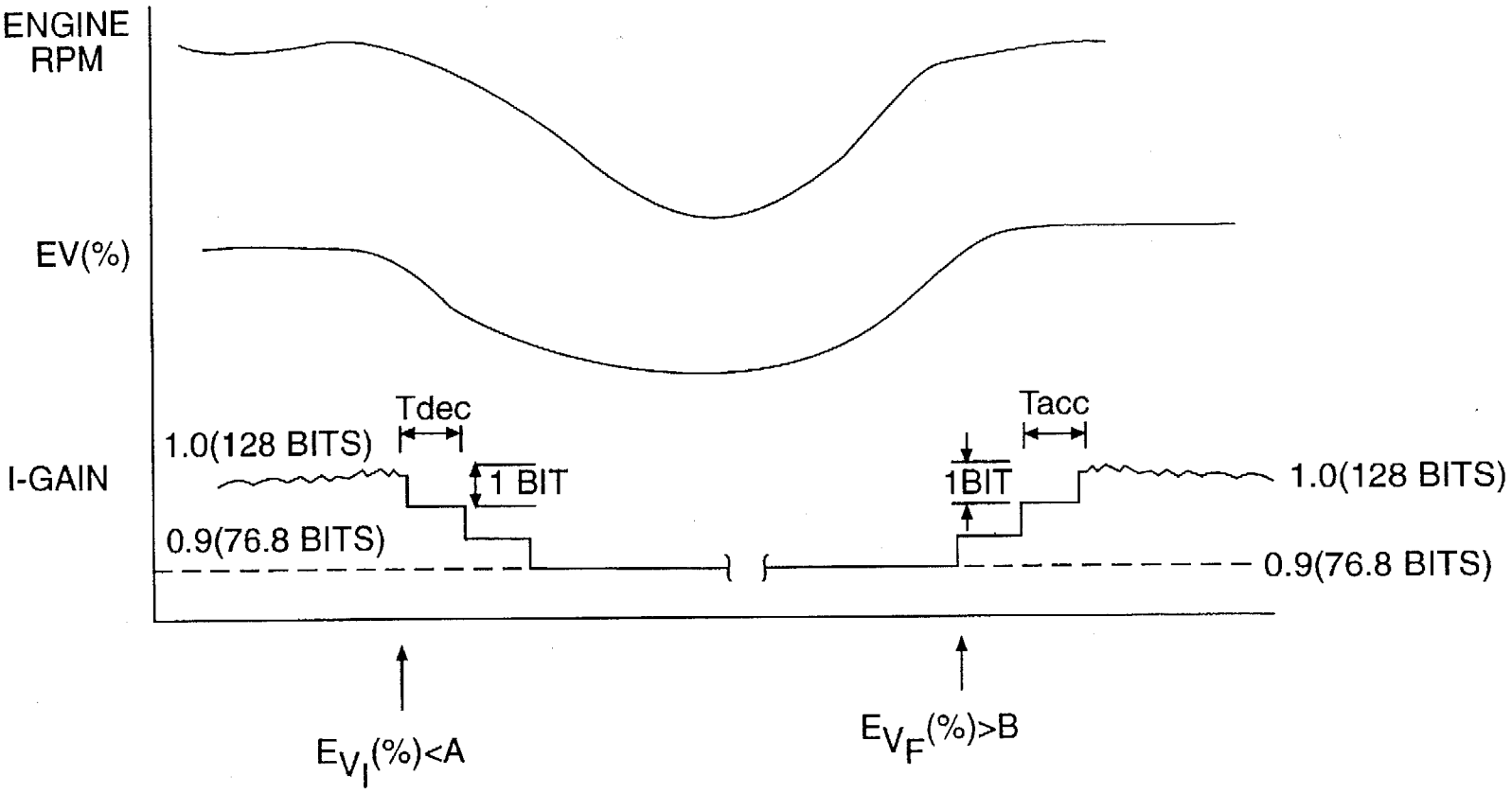
FIG. 4 is a graph depicting control of I-gain in the present invention.

Control of I-gain by ECU 16, in relation to engine RPM and Ev(%) is shown in FIG. 4.

In FIG. 4, $$I-\text{gain} = \frac{\text{Data} - 128(\text{bits})}{128 \times 4(\text{bits})} + 1$$

Data=

128 (bits) at I-gain=1.0

76.8 (bits) at I-gain=0.9

$T_{DEC}$ and $T_{ACC}$ are predetermined based on a desired time period during which I-gain is reduced from 1.0 to 0.9. For example, if the time duration during which I-gain drops to 0.9 level in 2–3 seconds, $T_{DEC}$ can be determined accordingly by dividing 2–3 seconds by (128–76.8) bits. $T_{ACC}$ can be determined in a similar manner.

The ECU 16 determines whether to operate in the F/B control mode or the "open loop" mode according to the following considerations. The ECU 16 considers water temperature in the engine against a setpoint, which may be, for example, 30° C. The ECU 16 also considers the extent that the throttle valve is open, $TH_O$, and the engine RPM. ECU 16 also considers the volumetric efficiency $E_v$(%).

Figure 5:
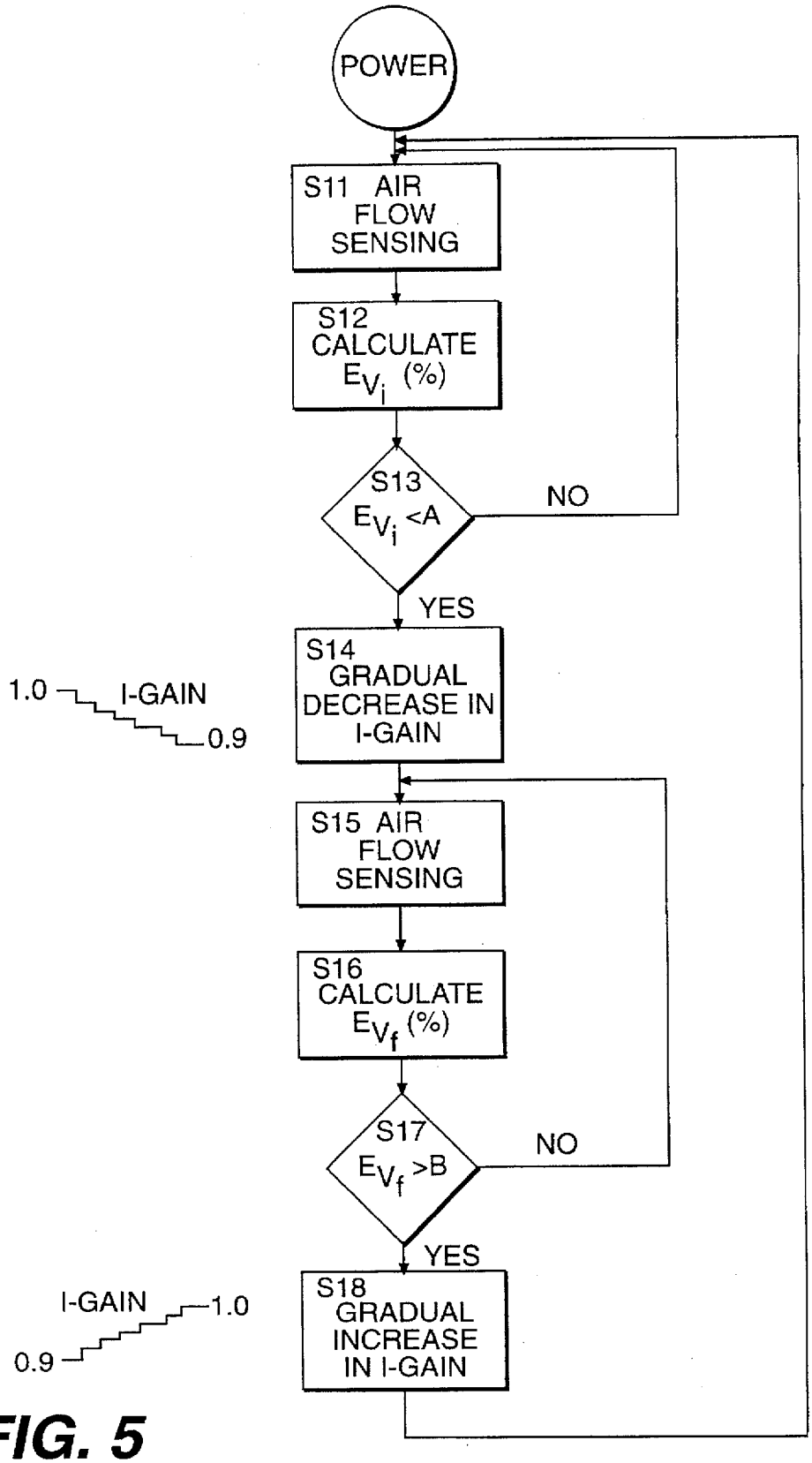
FIG. 5 is a flow chart depicting operation of the present invention.
Figure 6:
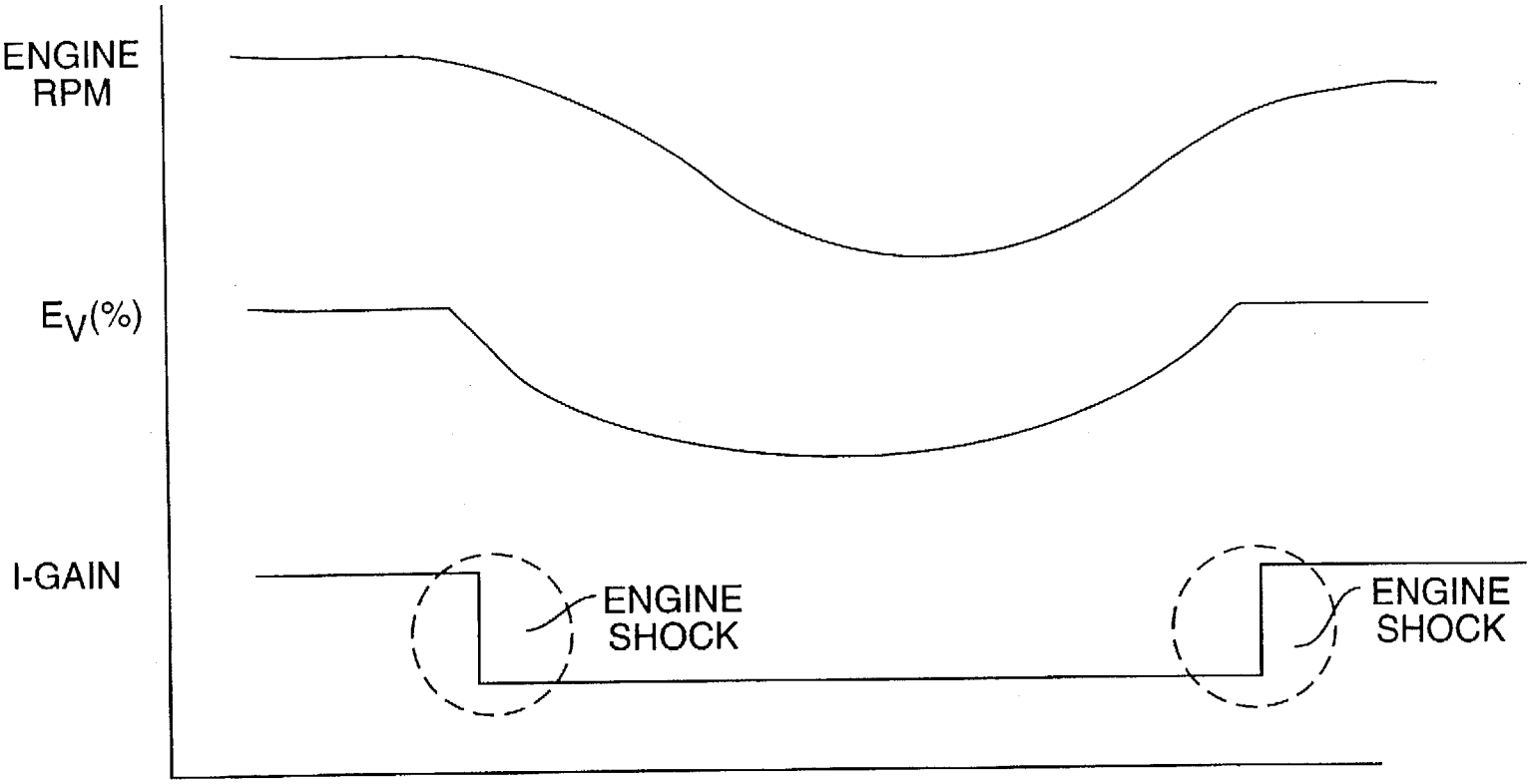
FIG. 6 PRIOR ART
FIG. 6 is a graph depicting control of I-gain in a conventional controller.

FIG. 5 is a flow chart depicting operation of the system in the F/B control mode, i.e., the $O_2$ level in the exhaust is sensed and used to determine the proper air fuel mixture by controlling I-gain.

First, in order to operate the control system, a DC voltage from a DC power supply unit (not shown) is applied to the several units, respectively.

At step S11, once the control system is powered, the intake air quantity sensing unit 12 senses the quantity of air supplied to the engine combustion chamber 13 and outputs the sensed signal to the ECU 16. The amount of air is used in the calculation of $E_v$(%) using formula (1) discussed above, at step S12.

The ECU 16 next compares $E_v$(%) determined at step S12 with a predetermined value of $E_v$(%), stored in the ECU 16, at step S13. If $E_{vi}$<A (which may be, for example, 15%), ECU 16 proceeds to step S14.

At step S14, the I-gain is adjusted gradually, in a series of discrete steps, to a steady state value, e.g., 0.9. As I-gain is gradually decreased, the fuel injection quantity also is gradually reduced to the predetermined declivity corresponding to a declivity set when the feedback compensating operation is suspended on the basis of the operating conditions of the vehicle. The ECU 16 then outputs a control signal to the fuel injection unit 18 so that the predetermined fuel quantity can be injected into the combustion chamber 13 of the engine.

At step S15, air flow sensor 12 continues to monitor air flow into the engine, and forwards a signal to ECU 16, which then calculates $E_{vf}$ at step S16 according to formula (1) above. When $E_{vf}$ reaches a setpoint B (e.g., 17%), at step S17, the ECU continues to step S18.

In the final step S18, I-gain is gradually increased in small incremented steps, to a steady state value of I, e.g., 1.0. Accordingly, fuel injected by fuel injection unit 18 is gradually increased.

As is apparent from the above description, the present invention provides a fuel injection quantity feedback control system of a vehicle capable of gradually increasing or reducing the fuel injection quantity to a predetermined quantity when the feedback control is suspended based on changing vehicles operating conditions. The system permits changes in fuel injection based on operating parameters of the vehicle without engine shock or reduced engine efficiency.

Additional advantages and modifications will readily occur to those skilled in the art. The invention in its broader aspects is not limited to the specific details described above, and departure may be made from such details without departing from the scope of the invention. The scope of the invention is established by the attached claims and their equivalents.

What is claimed is:

1. A vehicle fuel injection feedback control system, comprising:

a first sensing unit sensing a quantity of air supplied to a vehicle engine combustion chamber;

a second sensing unit sensing an $O_2$ content in exhaust from the combustion chamber;

a fuel injector for injecting fuel into the combustion chamber; and a controller receiving a first signal representing the sensed air quantity from the first sensing unit and converting the first signal into a parameter, and receiving a second signal representing the $O_2$ content from the second sensing unit, providing a control signal to the fuel injector to inject a selected quantity of fuel into the combustion chamber, and when the parameter reaches a setpoint, varying I-gain in a plurality of gradually changing steps.

2. The system of claim 1, wherein as the parameter decreases to a first setpoint, the controller decreases I-gain in a plurality of gradually decreasing steps.

3. The system of claim 1, wherein as the parameter increases to a second setpoint, the controller increases I-gain in a plurality of gradually increasing steps.

4. The system of claim 1, wherein the parameter is engine volumetric efficiency.

5. The system of claim 1, wherein the of fuel injector injects fuel in a plurality of gradually changing steps as the I-gain varies in gradually changing steps.

6. A method of controlling fuel injection to a vehicle engine combustion chamber, comprising the steps of:

sensing a quantity of air supplied to the combustion chamber;

sensing a quantity of $O_2$ in exhaust from the combustion chamber;

calculating a parameter based on the sensed air quantity;

comparing the parameter to a setpoint;

injecting fuel into the combustion chamber; and controlling an I-gain and, when the sensed parameter reaches the setpoint, varying the I-gain in a plurality of gradually changing steps.

7. The method claim 6, wherein as the parameter decreases to a first setpoint, the I-gain is decreased in a plurality of gradually decreasing steps.

8. The method of claim 6, wherein as the sensed parameter increases to a second setpoint, the I-gain is increased in a plurality of gradually increasing steps.

9. The method of claim 6, wherein the parameter calculated in the calculating step is engine volumetric efficiency.

10. The method of claim 6, wherein the step of varying an I-gain in a plurality of gradually changing steps varies the amount of fuel injected in a plurality of gradually changing steps.

* * * * *